US008353637B2

(12) United States Patent
Carroll et al.

(10) Patent No.: US 8,353,637 B2
(45) Date of Patent: Jan. 15, 2013

(54) TOGGLING COSMETIC SUBSTANCE DISPENSER

(76) Inventors: Craig Carroll, Newport Beach, CA (US); Steve Armstrong, San Juan Capistrano, CA (US)

( * ) Notice: Subject to any disclaimer, the term of this patent is extended or adjusted under 35 U.S.C. 154(b) by 732 days.

(21) Appl. No.: 12/392,051

(22) Filed: Feb. 24, 2009

(65) Prior Publication Data

US 2010/0215422 A1 Aug. 26, 2010

(51) Int. Cl.
*B43K 7/12* (2006.01)

(52) U.S. Cl. ..... 401/115

(58) Field of Classification Search ..... 401/115, 401/127, 129, 176, 274
See application file for complete search history.

(56) References Cited

U.S. PATENT DOCUMENTS

| | | | | |
|---|---|---|---|---|
| 2,547,287 | A * | 4/1951 | Sanders et al. | 401/112 |
| 2,944,274 | A * | 7/1960 | Hopkins | 401/102 |
| 3,420,611 | A * | 1/1969 | Towns | 401/115 |
| 3,832,071 | A * | 8/1974 | Chaney | 401/260 |
| 4,029,422 | A * | 6/1977 | Pillsbury | 401/117 |
| 4,594,014 | A * | 6/1986 | Korper | 401/115 |
| 4,838,722 | A * | 6/1989 | Katz | 401/101 |
| 4,991,749 | A | 2/1991 | Kay | |
| 5,722,436 | A | 3/1998 | Vandromme et al. | |
| 5,735,623 | A * | 4/1998 | Gueret | 401/115 |
| 6,082,918 | A | 7/2000 | Gueret | |
| 6,530,709 | B1 * | 3/2003 | Washington | 401/272 |
| 6,764,239 | B2 | 7/2004 | Kim | |
| 7,168,435 | B2 | 1/2007 | Vieu | |
| 2004/0184865 | A1 | 9/2004 | Carroll | |
| 2007/0141862 | A1 | 6/2007 | Gueret | |

FOREIGN PATENT DOCUMENTS

| | | |
|---|---|---|
| WO | PCT/US2008/074959 | 11/2008 |
| WO | PCT/US2010/025152 | 5/2010 |

OTHER PUBLICATIONS

U.S. Appl. No. 12/056,492, Aug. 25, 2009, carroll.
U.S. Appl. No. 12/056,492, Apr. 29, 2010, carroll.

* cited by examiner

*Primary Examiner* — Huyen Le
(74) *Attorney, Agent, or Firm* — John K. Buche; Buche & Associates, P.C.

(57) ABSTRACT

Disclosed is an improved toggling dispenser for dispensing substances.

42 Claims, 7 Drawing Sheets

TOGGLING COSMETIC SUBSTANCE DISPENSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present application is in the field of apparatuses for dispensing cosmetic substances. Specifically, the present application is in the field of apparatuses for dispensing and applying a cosmetic substance to finger and toe nails. More specifically, the present application is an all-in-one delivery apparatus (i.e., the applicator and lacquer reservoir are integrally associated as a single unit) that facilitates application of finger and toe nail polish, and the like.

2. Background of the Invention

A typical toggling cosmetic dispenser features an applicator that toggles in-and-out of the dispenser apparatus. The applicator collects a cosmetic substance while within the typical dispenser apparatus. While outside the typical dispenser apparatus, the applicator is configured to deliver the collected cosmetic substance to a target via contact between the applicator and the target. Generally, the typical dispenser is used by (1) toggling the applicator "in" to collect cosmetic substance, (2) toggling the applicator "out" to expose the applicator and collected lacquer, and (3) contacting a target with the exposed applicator to accomplish substance transfer thereto.

Many problems have been encountered through the use of typical toggling cosmetic dispensers. First, typical toggling cosmetic dispensers require many component pieces and are thus complicated, and expensive, to assemble. Next, the typical cosmetic dispenser comprises components that are made of materials that are expensive and therefore the manufacturing costs are high. Third, the ordinary toggling cosmetic dispensers comprise intricately fabricated pieces that require expensive machining and fabrication whereby the typical dispenser is too expensive to be "disposable."

Finally, typical dispenser designs are only compatible with substances within a very narrow range of viscosities, because the internal components of the ordinary dispensers do not function the same when loaded with substances of differing viscosities than contemplated in the design. Accordingly, many dispensers or dispenser designs may be necessary to accommodate the range of substances dispersible via an ordinary toggling dispenser.

SUMMARY OF THE INVENTION

Accordingly, it is an object of the present invention to provide a toggling cosmetic substance dispenser design with fewer component pieces.

It is yet another object of the present invention to provide a toggling cosmetic substance dispenser that comprises components of cheap material.

It is still a further object of the present invention to provide a toggling cosmetic substance dispenser comprising components that are minimally fabricated and that require minimal machining.

It is yet a further object of the present invention to provide a toggling cosmetic substance dispenser easily assembled by pressing pieces together.

It is still another object of the present invention to provide a toggling cosmetic substance dispenser wherein any cosmetic substance, regardless of its associated viscosity, is dispersible thereby.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally, the toggling dispenser of the present application is an all-in-one cosmetic substance dispenser. In other words, the cosmetic substance is contained and dispensed by a single dispenser apparatus. Suitably, the dispenser features an applicator that toggles in or out of the dispenser apparatus. While within the dispenser, the applicator accumulates a suitable amount of the contained cosmetic substance. While outside the dispenser, the applicator, loaded with substance, is suitably exposed for the directed delivery of the accumulated substance. The physical design of the dispenser components (for example: the size; the shape; the weight; and, the movement speeds) usually does not need to be modified for independently accommodating cosmetic substances of differing viscosities and specific gravities. The preferable operation of the dispenser achieves substance delivery to a target via contact between the loaded applicator and the target.

Figure 1:
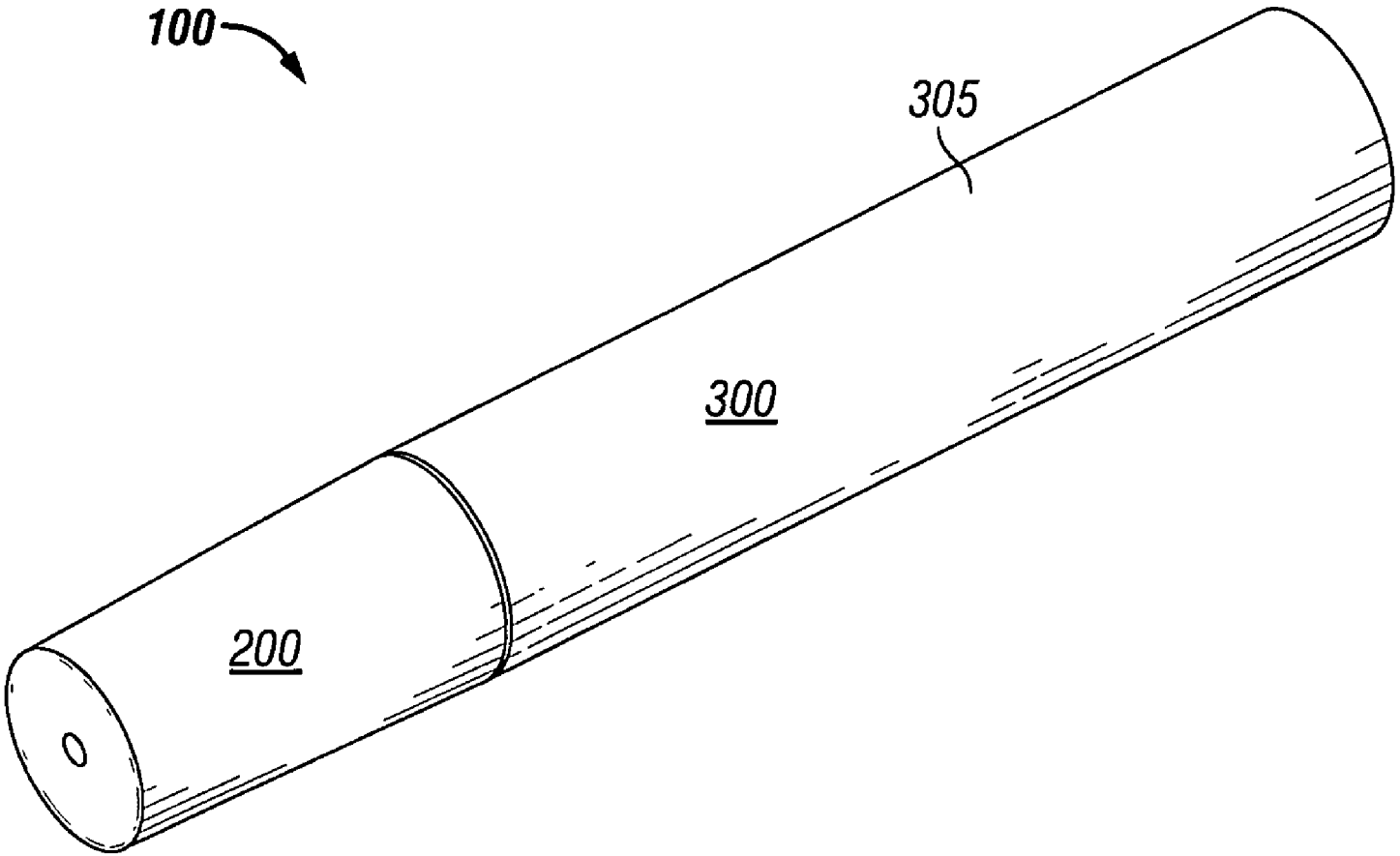
FIG. 1 is a perspective view of a capped dispenser 100.
Figure 2:
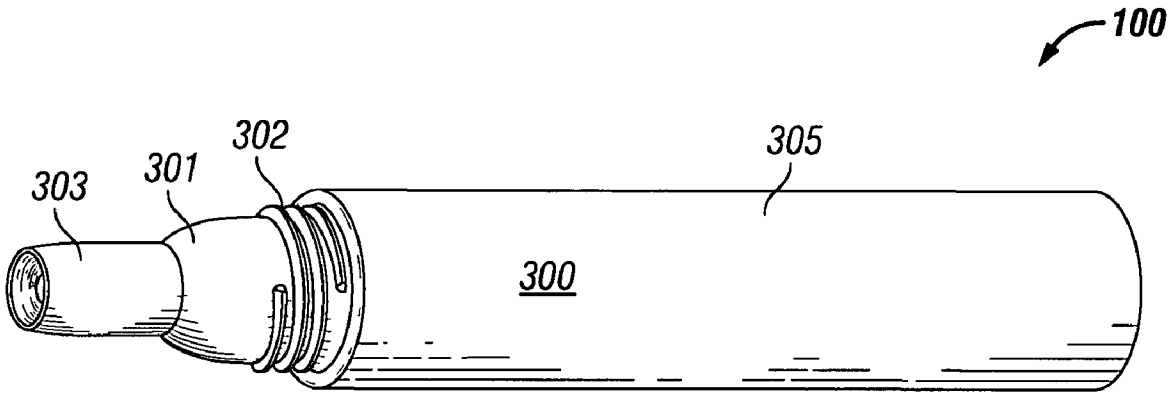
FIG. 2 is a perspective view of an uncapped toggled-in dispenser 100.
Figure 3:
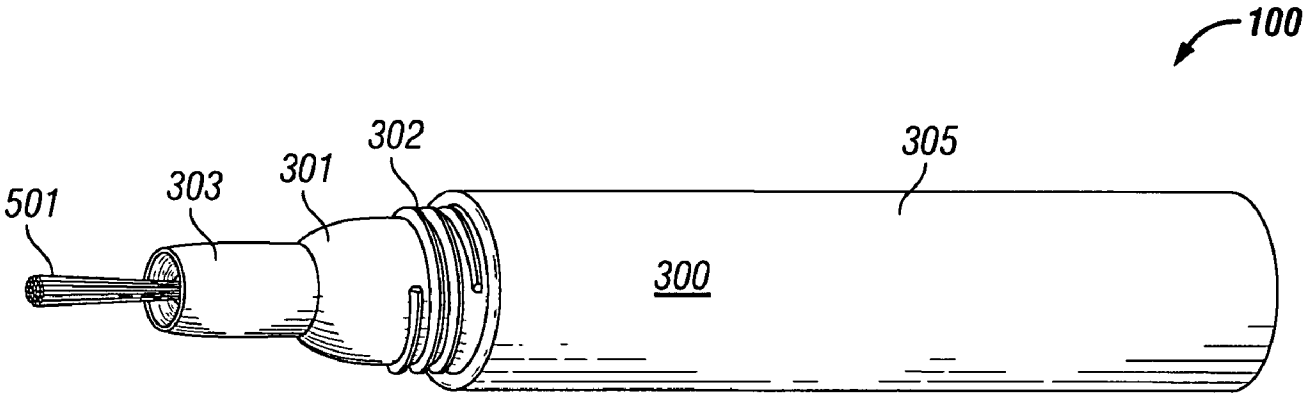
FIG. 3 is a perspective view of an uncapped toggled-out dispenser 100.

FIGS. 1 through 3 respectively depict the dispenser 100 of the present application in the following three preferable configurations encountered during the typical use: (1) the capped configuration; (2) the toggle-in configuration; and, (3) the toggle-out configuration. FIG. 1, the capped configuration, depicts the central structure 300 engaged with a removable cap 200. FIG. 2, the toggle-in configuration, depicts the central structure 300 disengaged from the removable cap 200 of FIG. 1 to show the head 301, the screw-threads 302, and the nose 303 at the fore of the body 305. FIG. 3, the toggle-out configuration, is a similar to the toggle-in configuration depicted by FIG. 2, except that FIG. 3 depicts an applicator 501 that is exposed from the nose 303.

When viewed together, FIGS. 1 through 3 provide a general overview of the basic operation of the dispenser 100. First, the capped dispenser 100 of FIG. 1 is preferably held with the cap 200 vertically superior to the body 305. Next, the cap 200 is disengaged from the body 305 by twisting the cap 200. The cap 200 is ultimately removed by separating the cap 200 from the body 305 to expose the head 301 and nose 303 as depicted in FIG. 2. While toggled-in (FIG. 2), the applicator 501 will preferably accumulate a contained substance, as discussed further below. Fourth, the applicator 501 is toggled-out, as depicted in FIG. 3, by shifting the orientation of the dispenser 100 whereby the head 301 is vertically inferior to the body 305. Finally, the exposed applicator 501 of FIG. 3, preferably previously loaded with substance while toggled-in, might be directed toward a target for accomplishing substance transfer thereto. Reversing the stated steps results in a capped dispenser 100 (FIG. 1) and suitably completes the basic operation of the dispenser 100.

Figure 4:
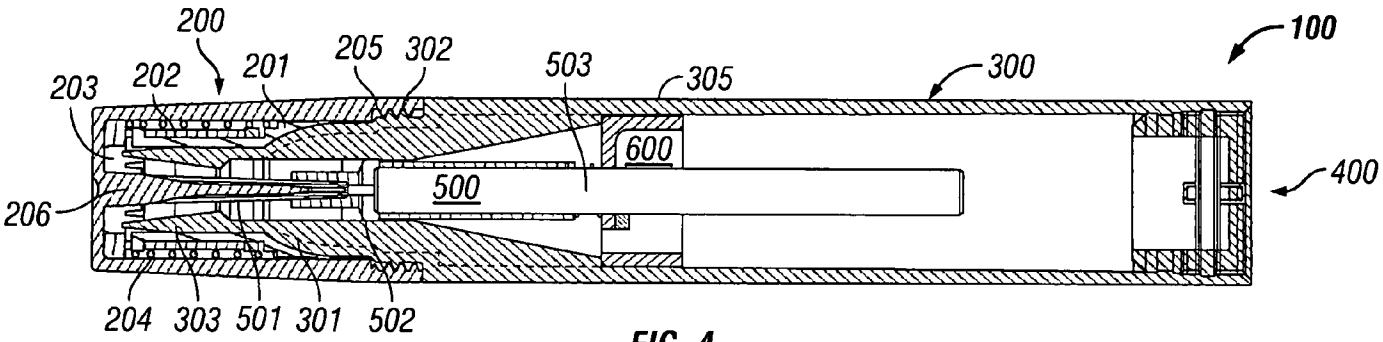
FIG. 4 is a longitudinal cross-section of a capped dispenser 100.
Figure 5:
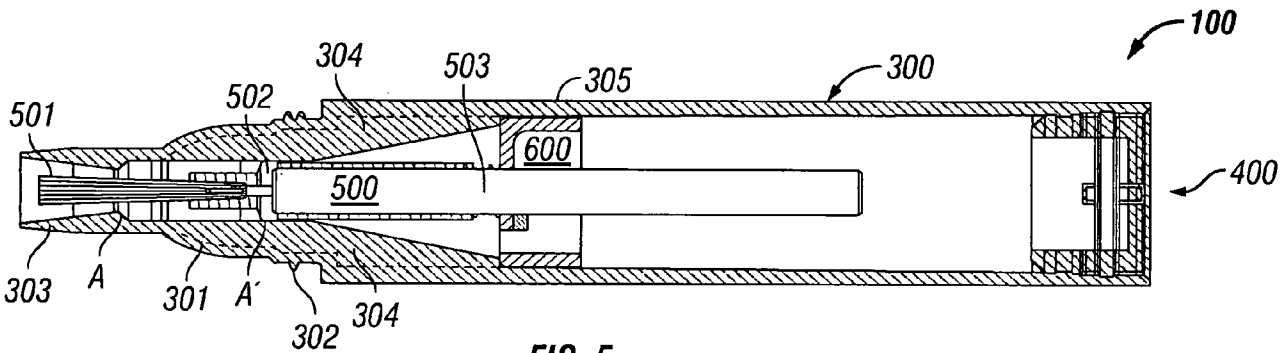
FIG. 5 is a longitudinal cross-section of an uncapped toggled-in dispenser 100
Figure 6:
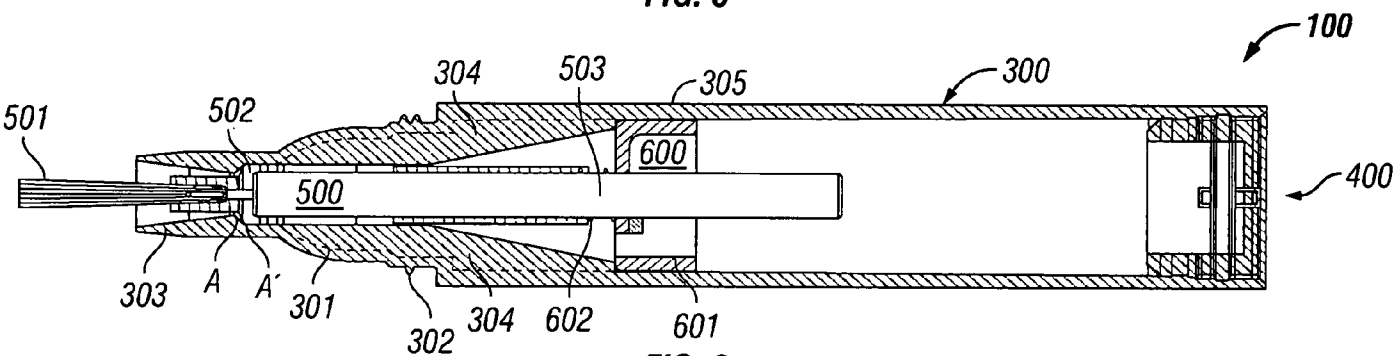
FIG. 6 is a longitudinal cross-section of an uncapped toggled-out dispenser 100.

FIGS. 4 through 6 respectively depict cross-sections of the dispenser 100 in the capped configuration, the toggle-in configuration, and the toggle-out configuration. As depicted in the figures, the dispenser 100 comprises five main components and subassemblies: (1) the cap 200; (2) the central structure 300; (3) the stopper 400; (4) the applicator assembly 500; and, (5) the shaft guide 600.

FIG. 4 depicts the cap 200 subassembly. As seen in the figure, the cap 200 comprises the nut-threads 205, the receiver 201, the hood 202, the plug 203, the cap spring 204, and the spreader 206. As illustrated by the figure, the cap 200 is basically configured to plug the nose 303, and engage the screw threads 302. A "screw" and "nut" mechanism is not the only means for engaging the cap 200 over head 301, and such other appropriate means (for example, snap, squeeze, clip, stick, press, interlock, and the like) will be readily ascertainable to one skilled in the art. The more particular aspects of the cap 200 and its constituent parts are discussed later in connection with FIGS. 8A through 8C.

FIGS. 4 through 6 depict the central structure 300 and stopper assembly 400. Still referring to FIGS. 4 through 6, the central structure 300 is preferably molded as a single component and typically comprises the nose 303, the head 301, the screw threads 302, the supports 304 (radially spaced ribs at along the head 301 and into the body 305), and the body 305. As seen in the figures, the central structure 300, from the nose 301 to the distal end of the body 305, is preferably non-uniformly tubiform. The stopper 400 is suitably insertable at the distal end of the body 305 for obstructing the tubiform channel of the central structure 300 to achieve a cavity between the nose 303 and the stopper 400. With the stopper 400 in place, the central structure 300 is capable of containing cosmetic substances and other fluids (i.e., the interface between the central structure 300 and the stopper 400 may provide a leak proof seal). The more specific aspects of the stopper 400 and its constituent parts are discussed later in connection with FIGS. 9A and 9B.

The central structure 300 and stopper 400 are often made of plastic materials, for example, a variety of hard plastics including but not limited to high-density polyethylene, polypropylenes, PVC, and other plastics that will be appreciated by those skilled in the art. Although glasses, metals, woods, and composites thereof may also be used to construct the central structure and plug, the costs of manufacturing the dispenser 100 can be minimized through the use of plastics. Manufacturing a central structure 300 and stopper 400 can be accomplished using the same materials and techniques that are used to manufacture the shell of a felt tip pen or magic marker (e.g., injection molding or the like). Those skilled in the art will appreciate other methods of dispenser 100 manufacturing.

FIGS. 4 through 6 depict the applicator assembly 500. The applicator assembly 500 comprises the applicator 501, the mount 502 and the weighted shaft 503. The mount 502 is preferably molded and represents an intermediary between the applicator 501 and the weighted shaft 503. The weighted shaft 503 is typically metal or another type of heavy material known to those skilled in the art. Without the mount 502, the weighted shaft would have to be machined for attachment to the applicator 501. Usually, the Applicator assembly 500 is movably situated within the preferably non-uniformly tubiform channel of the central structure 300, before the stopper 400 is placed at the distal end of the body 305. As discussed further below, the position of the applicator assembly 500 shifts within the central structure 300.

FIGS. 4 through 6 depict the shaft guide 600. The shaft guide 600 comprises the guide 601 and the compressible member 602. The shaft guide 600 is located within the central structure 300 and is preferably fixedly positioned adjacent to the supports 304 via an interference fit with the inner wall of the body 305. The shaft guide 600 and the supports 304 suitably direct the movements of the applicator assembly 500 within the central structure 300. Discussed below, the shaft guide 600 also participates in the regulation of substance dispensation.

Like FIGS. 1 through 3, FIGS. 4 through 6, when viewed together, generally provide an overview of the basic operation of the dispenser 100. However, unlike FIGS. 1 through 3, FIGS. 4 through 6 depict the internal components during basic dispenser 100 operation. First, the capped dispenser 100 of FIG. 1 is preferably held with the cap 200 vertically superior to the body 305. Next, the cap 200 is disengaged from the body 305 by twisting the cap along the screw-threads 302/nut-thread 205 interface. The cap 200 is ultimately removed by disengaging the receiver 201 from the nose 303 and head 301 to achieve the dispenser 100 configuration depicted in FIG. 5 (i.e., toggle-in). While toggled-in, the applicator 501 will preferably accumulate a portion of the contained substance from within the nose 303 and head 301, as discussed further below. Fourth, the applicator 501 toggles-out (FIG. 6) by shifting the weight of the weighted shaft 503 toward the nose 303 via adjusting the orientation of the dispenser 100 whereby the head 301 is vertically inferior to the body 305. Applicator assembly 500 movement within the dispenser 100 is preferably directed by the supports and the shaft guide 600. Finally, the exposed applicator 501 of FIG. 6, preferably previously loaded with substance while toggled-in, might be directed toward a target for accomplishing substance transfer thereto. Reversing the stated steps results in a capped dispenser 100 and suitably completes the basic operation of the dispenser 100.

Referring to FIGS. 5 and 6, the dispenser 100, while toggled-out, preferably does not leak the contained substance. In other words, only the amount of substance collected on the applicator 501 should be dispensed by the dispenser 100 during application to a target. Substance is prevented from exiting the nose 303 while the dispenser 100 is toggled-out by the interface (A to A') of the mount 502 and the internal wall of the nose 303. The interface (A to A') is suitably established by the weight of the weighted shaft 503 pressing the mount 502 against the inner wall of the nose 303 (A to A') sufficiently to prevent fluid from passing into the nose 303.

The design of the applicator 501 should be considered in light of undesirable leakage of substance from the nose 303. The applicator 501 should be relatively flexible and ductile so that contact with a target will not displace the mount 502 from its interface (A to A') with the nose 303. Accordingly, the applicator 501 of the present embodiment is depicted as a brush (or grouping of hair strands or fibers). Hypothetically, an inflexible applicator 7 (not shown) (whether the inflexibility is due to poor design or dry-out (discussed later below)) under a forceful contact with a target may displace the mount 502/nose 303 interface (A to A') and thereby allow the fluid substance to leak through the nose 303.

A more sophisticated mode of dispenser 100 operation involves toggling the dispenser 100 between applications of the contained substance to a target. While toggled-in (FIG. 5), the applicator 501 collects a substance from within the dispenser 100. While toggled-out (FIG. 6), the applicator 501 presents the collected substance for delivery to a target.

Toggling is best illustrated by FIGS. 2, 3, 5, and 6. Beginning with a toggled-out dispenser 100, as depicted in FIGS. 3 and 6, substance previously loaded to the applicator 501 is transferred to a target via contact between the applicator 501 and the target. Preferably, application of a substance is artfully achieved with the physical manipulation of the dispenser 100 over the target while the nose 303 and head 301 are vertically inferior to the body 305 (i.e., similar to the operation of an ink pen or marker). After application, the dispenser 100 is suitably toggled-in, as depicted in FIGS. 2 and 5, to refresh the load of contained substance on the applicator 501. Toggling-in is suitably accomplished by changing the orientation of the dispenser 100 whereby the nose 303 and head 301 are vertically superior to the body. While inside the dispenser 100, the applicator 501 suitably collects substance, as discussed below. Finally, toggling the dispenser 100 out will present the applicator 501 with a fresh dose of substance for application to a target. In the typical dispenser 100 use, repeated toggling of the dispenser 100 before substance application will increase the amount of substance loaded to the dispenser 100 and thereby increase the dose of substance received by the target upon contact therewith.

The toggling parameters of a dispenser 100, loaded with nail polish, have been compared with the toggling parameters of an empty dispenser 100, wherein the weighted shaft 503 weighs 7.8 grams. The results indicate that if a loaded dispenser 100 is tilted with the nose 303 vertically inferior to the body 305, by approximately 30° relative to a horizontal orientation, the dispenser 100 will toggle-out as depicted in FIG. 6. Conversely, the dispenser 100 will toggle-in, as depicted in FIG. 5, by tilting the nose 303 vertically superior to the body, by approximately 30° relative to a horizontal orientation. In contrast to a loaded dispenser 100, an empty dispenser 100 toggles with an approximately 15° tilt relative to the horizontal. Of course, the toggling angles change with the viscosity of the loaded substance, and weight of the weighted shaft 503. For example, a dispenser 100 filled with water, toggles at similar angles to those mentioned above when the weighted shaft 503 weighs 0.4 grams. Accordingly, the weight of the weighted shaft 503 may be varied to accommodate different substances. Suitably, the dispenser 100 may feature a weighted shaft 503 weighing from 0.1 grams to 15 grams.

Referring still to FIGS. 2, 3, 5 and 6, the dispenser 100 preferably regulates the amount of substance dispensed by each toggle of the dispenser 100. During the dispenser 100 transition from a toggled-out (FIG. 6) to a toggled-in (FIG. 5) configuration, the weighted shaft 503 (guided by the shaft guide 600 and supports 304) displaces the contained substance an air contained in the central structure 300 thereby forcing substance present on the inner wall of the head 301 (due to surface tension) into the nose 303 for collection by the application 501.

Figure 7:
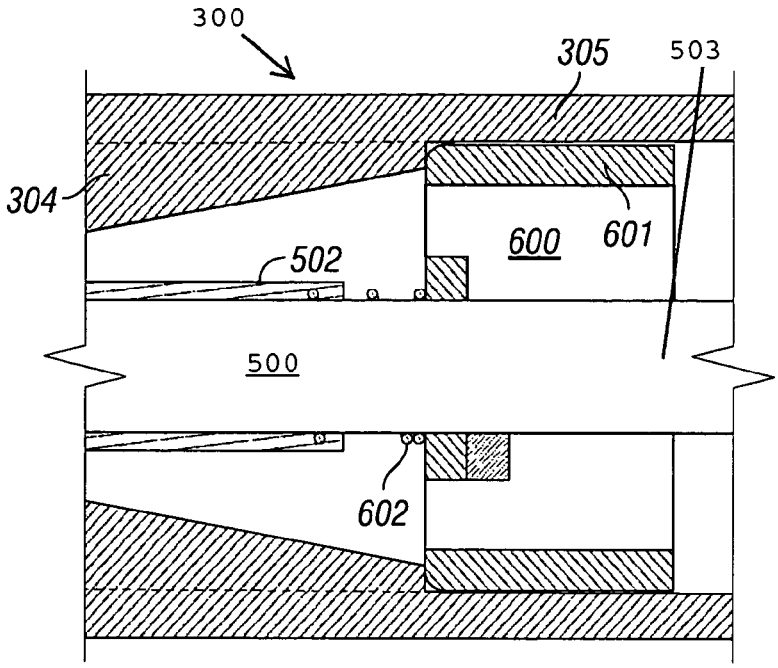
FIG. 7 is a longitudinal cross-section of the shaft guide 600.

FIG. 7 is an enlarged view of the shaft guide 600 depicted in FIGS. 4 through 6. The guide 601 suitably directs the stroke of the weighted shaft 503 during dispenser 100 toggle. The guide 601 is internally positioned within the body 305 adjacent to the supports 304 via an interference fit. The guide 601 should preferably feature apertures whereby a contained substance may flow freely between the body 305 and the head 301 (i.e., through the guide 601).

Still referring to FIG. 7, the compressible member 602 is preferably positioned around the weighted shaft 503 between the guide 601 and the mount 502. Preferably, the compressible member 602 compresses against the mount 502 and guide 601 when the dispenser 100 is toggled-in (as seen in FIGS. 5 and 7) to control the distance the applicator assembly 500 moves within the body 305. As discussed below, the compressible member 602 is preferably an advanced feature for universalizing the compatibility of dispenser 100 components with contained substances of varying viscosities and specific gravities.

To avoid overloading the applicator 501 with substance during any single dispenser 100 toggle, the disassociation and re-association of the interface (A to A') must be monitored (i.e., the transition from a FIG. 6 configuration to a FIG. 5 configuration and back to a FIG. 6 configuration). If the disassociation of the interface (A to A') is too long (in time or distance), too much substance will be provided to the applicator 501. Conversely, if the disassociation of the interface (A to A') is too short (in time or distance), too little substance will be provided to the applicator 501. In the dispenser 100, the compressible member 602 preferably defines the distance of disassociation (A to A' FIG. 5) and the weight of the weighted shaft 503 preferably defines the speed of re-association (A to A'). Rather than adjusting the weight of the weighted shaft 503 (which involves a relatively difficult substitution of a relatively expensive component) to manipulate the length (time only) of disassociation (A to A' FIG. 5), the length and/or resistance of the compressible member 602 may be adjusted (which involves a relatively easy substitution of a relatively cheap component) to manipulate the length (time or distance) of disassociation (A to A' FIG. 5) and thereby produce compatibility between a dispenser 100 and all candidate substances with varying viscosities or specific gravities. For example, one embodiment of the dispenser 100 might use a spring with a length in the range of 0 in. to 1 in. (typically 0.13 in.) as the compressible member 602. Alternatively, the length of the mount 502 could be adjusted to manipulate the length (time or distance) of disassociation (A to A' FIG. 5).

The preferable displacement of the interface (A to A' FIG. 5) during the typical dispenser toggle is from 0.001 cm. to 3 cm. A dispenser 100 could be designed for a particular substance without a compressible member 602 wherein the shaft guide 600 functions to regulate the proper displacement of the interface (A to A' FIG. 5) by blocking the weighted shaft 503 from passing through the guide 601 beyond the mount 502. The compressible member could then be added to accommodate use of an alternate substance with a different viscosity than the designed viscosity tolerance for the dispenser 100.

Figure 8A:
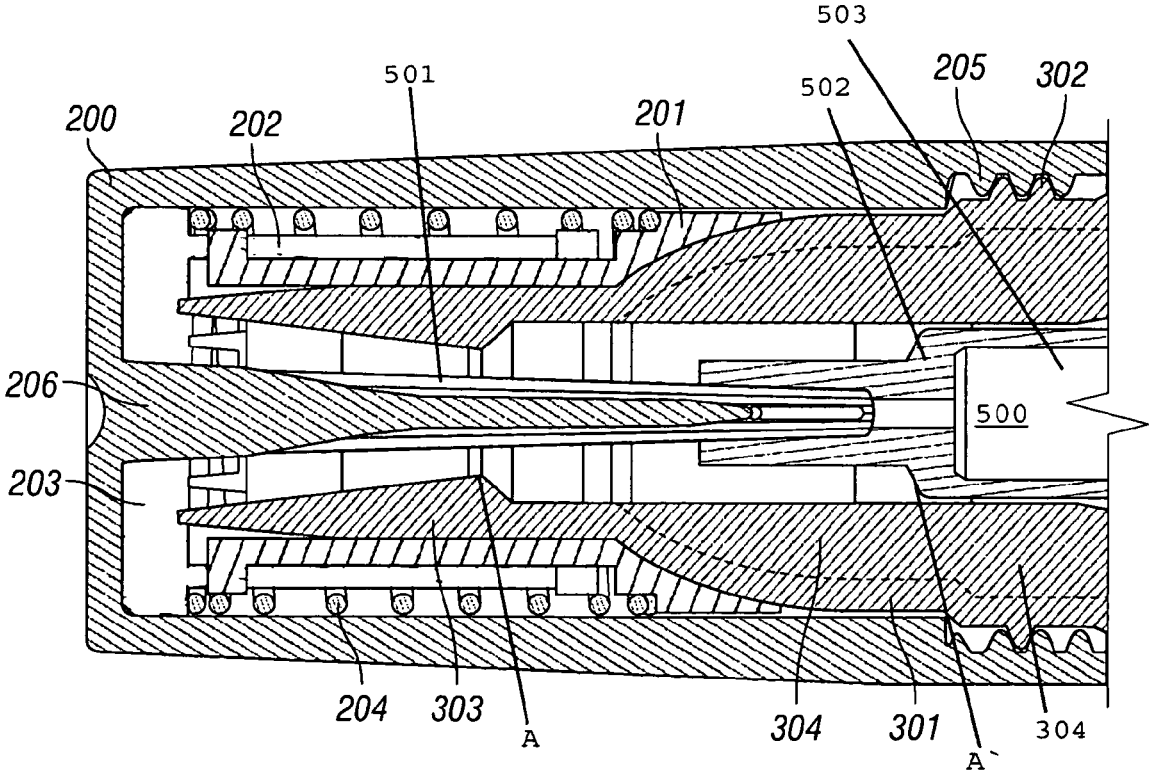
FIG. 8A is a cross-section of a cap 200 engaged with a dispenser 100.
Figure 8B:
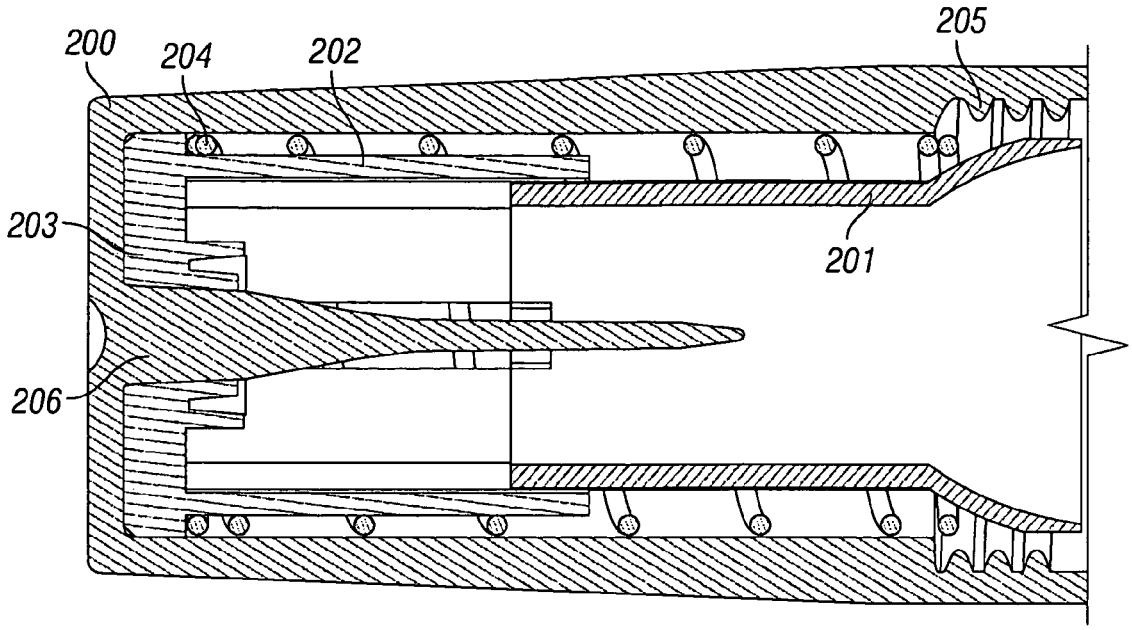
FIG. 8B is a cross-section of a cap 200 in a first configuration.
Figure 8C:
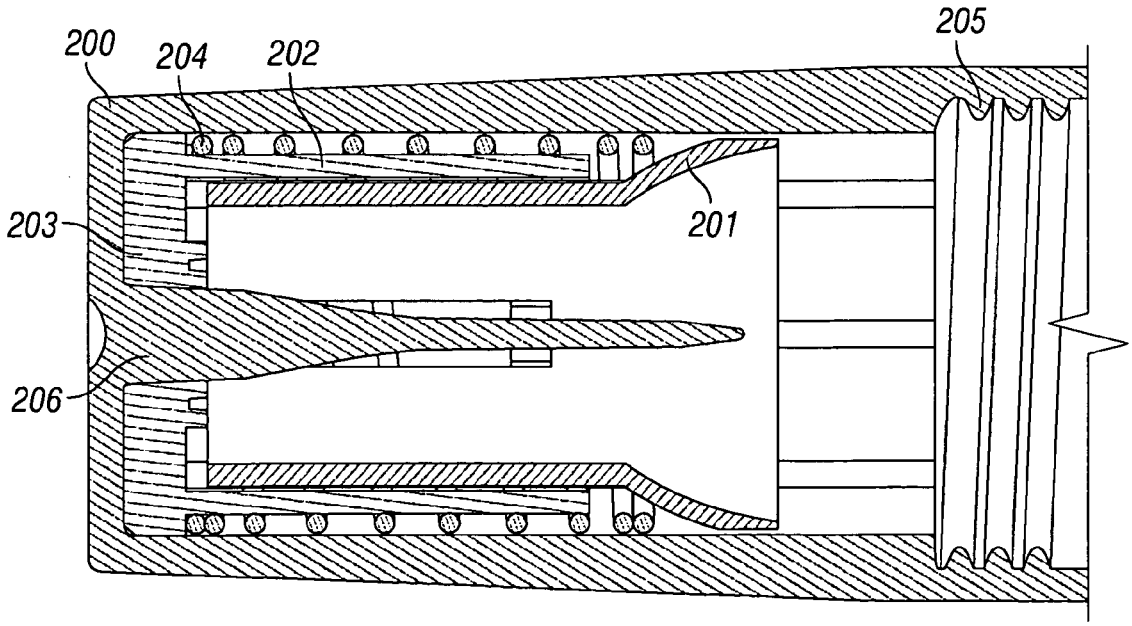
FIG. 8C is a cross-section of a cap 200 in a second configuration.

FIGS. 8A through 8C illustrate the internal components of the cap 200. The cap 200 comprises the nut threads 205, the receiver 201, the hood 202, the plug 203, the cap spring 204, and the spreader 206. The spreader may be integral with the cap 200 (as shown in the figure) or may be a separate component. As mentioned above, the cap 200 is removably engaged to the head 303 via rotable interface between the screw 302 and nut 205 threads.

As seen in FIG. 8A through 8C, the cap 200 is preferably flat on its distal end. The flat portion of the cap 200 defines a means for basing the dispenser 100 during periods of non-use. Generally, the applicator 501 occupies the head 301 and nose 303 while the dispenser is in a capped position (see FIGS. 4 and 9A). IF the dispenser 100 is based by the stopper 400 (FIG. 4) during periods of non-use, the contained substance will be driven by gravity into the body 305 and away from the applicator 501. When the applicator 501 is not submerged in the contained substance, the residual substance on the applicator 501 may dry-out and render the applicator unusable. Although the dry-out is a concern, dry-out may not result in total failure of the dispenser 100. Dried-out internal components may be cured to their functional states by resaturation with contained substance.

FIG. 8A is a truncated cross section of the capped dispenser 100 that was previously depicted in FIGS. 1 and 4. More specifically this figure is an enlarged depiction of the cap 200 engaged over the nose 303 and head 301. Note that, like the toggled-in dispenser 100 depicted in FIG. 5, the mount 502 is disassociated from the nose 303 whereby the interface (A to A' depicted in FIG. 6) is not established.

An unestablished interface (A to A' as depicted in FIG. 8A) is preferable for a capped dispenser 100 because the contained substance may freely enter and exit the nose 303 and head 301 for continuous saturation of the applicator 501. An established interface (A to A' as depicted in FIG. 6) would unpreferably isolate the applicator 501 from the contained substance for potential dry-out. Referring again to FIG. 8A, the spreader 206 preferably props the applicator assembly 500 to preserve an unestablished interface (A to A' as depicted in FIG. 8A).

As mentioned above, the compressible member 602 defines the preferable toggle distance of the applicator assembly 500 for providing appropriate amounts of contained substance to the applicator 501. However, the compressible member 602 does not prevent the applicator 500 assembly from being propped further within the dispenser 100 than the appropriate toggle distance. In other words, the compressible member 602 may preferably compress further under the force of the spreader 206 than under the typical forces encountered during toggling of the dispenser 100.

Still referring to FIG. 8A, the cap 200 also plugs the nose 303 of the capped dispenser 100. As depicted clearly in FIG. 8A, the plug 203 masculinely inserts to the nose 303, thereby forming a seal via elastical deformation of the plug 203 within the nose 303. Preferably, the elastic force from the plug 203 deformation produces the seal for preventing the undesirable leakage of contained substance.

FIG. 8A also shows the geometry of the nose 303. Preferably the inner nose 303 tapers from larger-to-smaller. In one embodiment of the nose 303, the inner wall tapers from one-eighth to one-quarter inch. The taper allows the applicator 501 (especially brush applicators) to enter and exit the nose 303 without damage.

Still referring to FIG. 8A, the cap 200 also preferably preserves the integrity of the applicator 501, particularly brush-type applicators. As mentioned above, the spreader 206 is configured to engage the applicator 501 for propping the applicator assembly 500. Without the spreader 206 to prop the applicator assembly 500, the applicator 501 would deform under the weight of the weighted shaft 503.

Most particularly, FIGS. 8B and 8C illustrate the internal mechanisms of the cap 200. To engage the applicator assembly 500, as discussed above, the spreader 206 ideally passes through the nose 303 unobstructedly during cap 200 placement. In other words, the spreader 206 and the nose 303 should typically maintain an approximately coaxial relationship during the engagement of the cap 200 over the nose 303 and head 301. This approximately coaxial relationship is ensured by a receiver 201 movably situated within the hood 202 of the cap 200. The receiver 201 is defaultly positioned at the opening of the cap 200 (as seen in FIG. 8B) by the cap spring 204, and will not engage the nose 303 without an initial coaxial interaction. Thus engaged with the nose 303, the receiver 201 unobstructedly guides the nose 303 through the cap 200 (see FIG. 8C) and delivers the nose 303 to the plug 203 and the spreader 206 to the applicator 501 during cap 200 placement (as seen in FIG. 8A).

The receiver 201 also preserves the coaxial relationship of the spreader 206 and the nose 303 during cap 200 removal. Upon disengagement of the cap 200 from head screw 302, the spring 204 expands to force the nose guide 304 to its default location at the opening of the cap 200 (i.e., the transition from the configuration in FIG. 8C to the configuration depicted in FIG. 8B). The nose guide ensures the coaxial relationship of the spreader 206 and nose 303 until the receiver 201 and the nose 303 are disengaged.

Figure 9B:
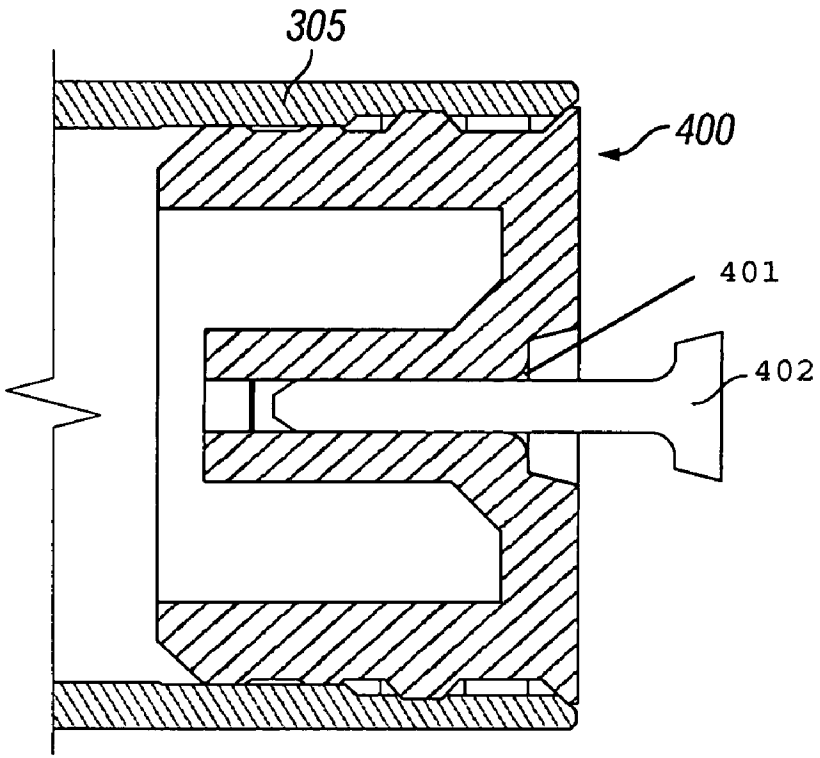
FIG. 9B is a cross-section of a stopper 400 with an open vent 401 and side vent 403.
Figure 9A:
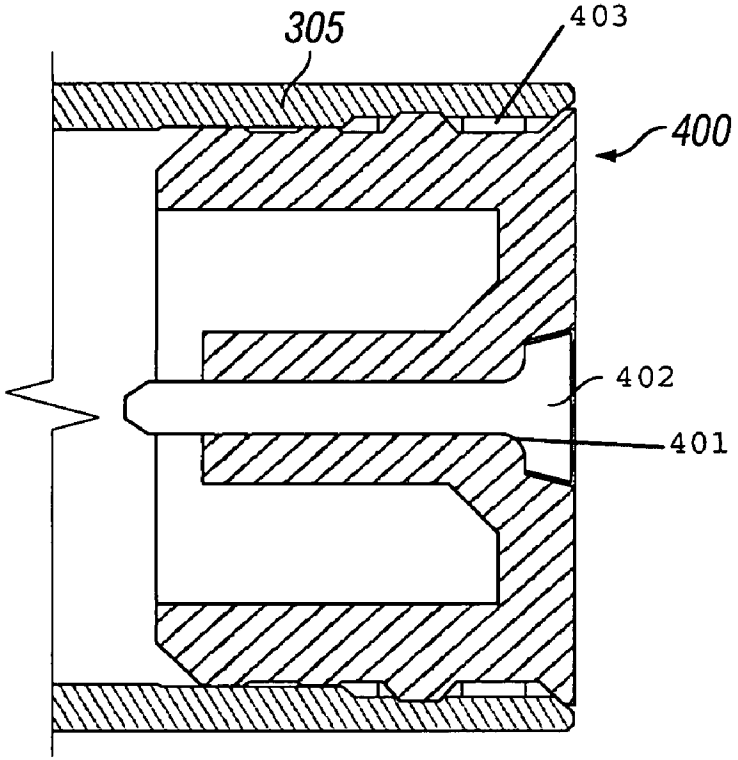
FIG. 9A is a cross-section of a stopper 400 with a closed vent 401.

FIGS. 9A and 9B are truncated cross-sections of a dispenser 100 that was previously depicted in FIGS. 4 through 6. As mentioned above, the stopper 400 preferably occupies the distal end of the central structure 300 for rendering the dispenser 100 capable of containing a substance. To relieve air pressure caused by gasses trapped within the dispenser 100, the stopper 400 may feature a resealable vent 401. FIG. 9A depicts the stopper 400 with the vent pin 402 closed. FIG. 9A also depicts vent channel 403 in the body 305 to further aid in releasing air and substance pressure build up in the central structure 300 when the stopper 400 is inserted into the distal end of the body 305. FIG. 9B depicts the stopper 400 with the vent 401 open.

Figure 10:
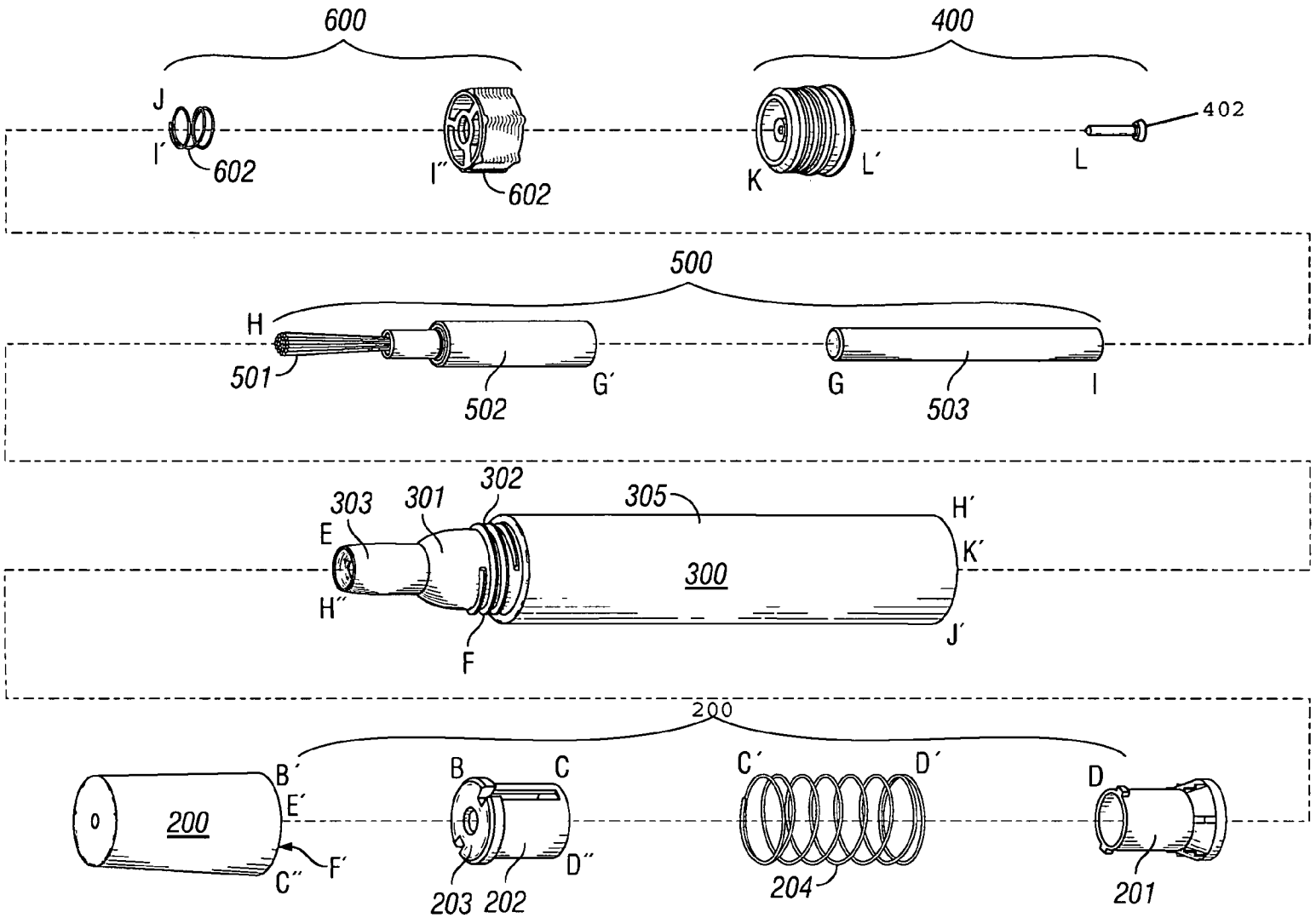
FIG. 10 is an exploded view of a dispenser 100.

FIG. 10 is an exploded view of the dispenser 100 and represents an inventory of components necessary for dispenser 100 assembly. FIG. 10 also represents a disassembled view of the dispenser 100 of the present application, which might be assembled along the dashed line beginning with the cap 200 and continuing to the tail stopper 400. More specifically, the dispenser 100 may be assembled as follows. First, the cap 200 is assembled by (1) inserting the hood 202 into the cap 200 (B to B') whereby the spreader 206 coaxially engages the hood 202, (2) inserting the cap spring 204 into the cap 200 (C' to C") whereby the hood 202 coaxially inserts into the spring 204 (C to C'), and (3) inserting the receiver 201 into the spring 204 and hood 202 (D to D' to D"). Second, the central structure 300 is capped by engaging the nose 303 with the receiver 201 (E to E'), and interfacing the screw 302 and nut threads 205 (F to F'). Third, the applicator assembly 500 is placed in the dispenser 100 by inserting the weighted shaft into the mount 502 (G to G') and placing the assembly 500 into the body 305 (H to H') until the applicator 501 is positioned in the nose 303 and head 301 (H to H' to H"). Fourth, within the body 305, the weighted shaft 503 is inserted through the compressible member (I to I') and guide 601 (I to I") while the shaft guide 600 is simultaneously placed within the body 305 (J to J'). Fifth, a substance may be poured into the body 305 at its distal end. Sixth, the stopper 400 is inserted into the distal end of the body 305 (K to K'). Finally, the plug 401 is placed in the stopper 400 (L to L').

It should be noted that FIGS. 1 through 10 and the associated descriptions are of illustrative importance only. In other words, the depictions and descriptions of the present invention should not be construed as limiting of the subject matter in this application. The apparatuses, assemblies, components, and methods discussed hereby are susceptible to modification without changing the overall concept of the disclosed invention. Such modifications might become apparent to one skilled in the art after reading this disclosure.

We claim:

1. A toggling dispenser comprising a structure for containing a substance;

an applicator with a mount for delivering said substance, wherein said applicator and said mount are togglable between substance collection and substance delivery configuration;

a toggling means;

a compressible member for calibrating said toggling means for use with substances of differing physical properties;

wherein said mount and said compressible member are out of contact in said substance delivery configuration; and, wherein said mount and said compressible member are in contact in said substance collection configuration.

2. The toggling dispenser of claim 1 wherein said structure for containing a substance is a tubiform central structure and a stopper for blocking said tubiform configuration.

3. The toggling dispenser of claim 2 wherein said tubiform central structure is fabricated as a single component.

4. The toggling dispenser of claim 2 wherein said stopper features a vent.

5. The toggling dispenser of claim 1 wherein said toggling means is defined by a weighted shaft that is regulatedly movable within said structure.

6. The toggling dispenser of claim 5 wherein said calibration of said toggling means is accomplished by adjusting the said movability of said weighted shaft.

7. The toggling dispenser of claim 1 wherein said applicator is a collection of fibers.

8. The toggling dispenser of claim 1 wherein said applicator is brush.

9. The toggling dispenser of claim 1 wherein said compressible member is a spring.

10. The dispenser of claim 1 wherein said dispenser further comprises a cap with a spreader.

11. The toggling dispenser of claim 1 wherein said structure for containing substance features a vent.

12. The dispenser of claim 1 wherein a substance collection point tapers from one-eighth inch to one-quarter inch.

13. A method for calibrating a toggling dispenser for dispensing substances of differing physical properties, comprising the steps of:

obtaining a toggling dispenser with substance collection and substance delivery configurations; and, installing a compressible member that (a) interacts with a toggling means of said toggling dispenser in said substance collection configuration and (b) does not interact with the toggling means in said substance delivery configuration.

14. The method of claim 13 wherein said toggling means is defined by a weighted shaft that is regulatedly movable within said toggling dispenser.

15. The method of claim 14 wherein said installation of said compressible member adjusts the said movability of said weighted shaft.

16. The method of claim 13 wherein said compressible member is a spring.

17. The method of claim 13 wherein said dispenser is disposable.

18. The method of claim 13 wherein said dispenser is disposable.

19. A method of assembling a toggling dispenser comprising the steps of:

assembling a toggling dispenser featuring an applicator and a toggling means; and, installing a compressible member that (a) interacts with the toggling means in said substance collection configuration and (b) does not interact with the toggling means in said substance delivery configuration.

20. The method of claim 19 wherein said toggling means is defined by a weighted shaft that is regulatedly movable within said toggling dispenser.

21. The method of claim 20 wherein said installation of said compressible member adjusts the said movability of said weighted shaft.

22. The method of claim 19 wherein said compressible member is a spring.

23. A toggling dispenser comprising:

a central structure, tubiform between a nose and a body;

a stopper, configured to obstruct said tubiform configuration of said central structure whereby said central structure is operationally configured to contain a cosmetic substance;

an applicator operationally configured to collect said cosmetic substance;

a weighted shaft that is regulatedly movable within said central structure, said weighted shaft configured to deliver said applicator to a location for collection of said substance and a location for delivery of said substance;

a compressible member for regulating said movement of said weighted shaft; and, wherein said weighted shaft delivers said applicator to said location for collecting said contained substance by orienting said nose vertically superior to said body by approximately 30 degrees relative to a horizontal origin.

24. The dispenser of claim 23 wherein said compressible member is a spring.

25. The dispenser of claim 23 further comprising a cap with a spreader.

26. The dispenser of claim 23 further comprising a means for guiding said movement of said weighted shaft.

27. The dispenser of claim 23 wherein said means for guiding said movement of said weighted shaft is a shaft guide and at least one support within said central structure.

28. The dispenser of claim 23 wherein said spring features a length in the range of 0 to 1 inch.

29. The dispenser of claim 23 wherein said compressible member regulates the movement of said weighted shaft to distances in the range of 0.01 centimeters to 3 centimeters.

30. The dispenser of claim 23 wherein said weighted shaft has a weight in the range of 0.1 grams to 15 grams.

31. The dispenser of claim 23 wherein said nose defines a substance collection point, and wherein said nose internally tapers from one-eighth inch to one-quarter inch.

32. A toggling dispenser comprising:

a central structure, tubiform between a nose and a body;

a stopper, configured to obstruct said tubiform configuration of said central structure whereby said central structure is operationally configured to contain a cosmetic substance, an applicator operationally configured to collect said cosmetic substance;

a weighted shaft that is regulatedly movable within said central structure, said weighted shaft configured to deliver said applicator to a location for collection of said substance and a location for delivery of said substance;

a compressible member for regulating said movement of said weighted shaft; and, wherein said weighted shaft delivers said applicator to said location for delivery of said substance by orienting said nose vertically inferior to said body by approximately 30 degrees relative to a horizontal origin.

33. A toggling dispenser comprising:

a central structure;

a stopper disposed in said central structure, said stopper featuring a vent that is permanently closed by a vent pin;

a substance that was in the central structure when said vent was closed by said vent pin an applicator for collecting and delivering a substance, said applicator togglable between substance collection and substance delivery configurations; and, a toggling means.

34. The toggling dispenser of claim 33 further comprising an interchangeable component for calibrating said toggling means for use with substances of differing physical properties, wherein said interchangeable component (a) interacts with the toggling means in said substance collection configuration and (b) does not interact with the toggling means in said substance delivery configuration.

35. The toggling dispenser of claim 34 wherein said interchangeable component is a compressible member.

36. The toggling dispenser of claim 34 wherein said interchangeable component is a mount for mounting said applicator to said toggling means.

37. The dispenser of claim 34 wherein said central structure features a plurality of radially spaced supports.

38. The dispenser of claim 33 wherein said central structure features at least one support.

39. A method for calibrating a toggling dispenser for dispensing substances of differing physical properties, comprising the step of:

Reducing the distance that a mount for mounting a applicator to a toggling means moves while said toggling dispenser is operated between substance collection and substance delivery configurations via installing a compressible member.

40. The method of claim 39 wherein said toggling means is defined by a weighted shaft that is regulatedly movable within said toggling dispenser.

41. The method of claim 39 wherein said compressible member is a spring.

42. The method of claim 39 wherein said dispenser is disposable.

* * * * *